US008683961B2

(12) United States Patent
Prior et al.

(10) Patent No.: US 8,683,961 B2
(45) Date of Patent: Apr. 1, 2014

(54) FLUID SYSTEM AND METHOD OF CONTROLLING FLUID FLOW FOR AN INTERCOOLER

(75) Inventors: Gregory P. Prior, Birmingham, MI (US); E. Timothy Pawl, West Bloomfield, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 80 days.

(21) Appl. No.: 13/329,709

(22) Filed: Dec. 19, 2011

(65) Prior Publication Data

US 2013/0153198 A1 Jun. 20, 2013

(51) Int. Cl.
*F01P 9/00* (2006.01)
*F01P 7/02* (2006.01)

(52) U.S. Cl.
USPC ..... 123/41.01; 123/41.05

(58) Field of Classification Search
USPC ..... 123/41.05, 41.01
See application file for complete search history.

(56) References Cited

U.S. PATENT DOCUMENTS

| | | | | | |
|---|---|---|---|---|---|
| 4,632,178 | A * | 12/1986 | Hirano | 165/299 |
| 4,949,544 | A * | 8/1990 | Hines | 60/728 |
| 4,961,404 | A * | 10/1990 | Itakura et al. | 123/41.31 |
| 5,669,338 | A * | 9/1997 | Pribble et al. | 123/41.29 |
| 6,006,731 | A * | 12/1999 | Uzkan | 123/563 |
| 6,178,928 | B1 * | 1/2001 | Corriveau | 123/41.12 |
| 7,172,016 | B2 * | 2/2007 | Meshenky et al. | 165/173 |

* cited by examiner

*Primary Examiner* — Lindsay Low
*Assistant Examiner* — Charles Brauch
(74) *Attorney, Agent, or Firm* — Ralph E. Smith

(57) ABSTRACT

A fluid system for an intercooler has a fill level defining a maximum volume of liquid in the fluid system, a main fluid circuit and a secondary fluid volume. The main fluid circuit includes the intercooler, and one or more passages through which fluid is circulated with operation of the engine, and at least a portion of the main fluid circuit is located above the fill level. The secondary fluid volume has at least a portion located below the fill level that communicates with the main fluid circuit to receive liquid from the main fluid circuit at least when the engine is not operating to drain at least some of the liquid from the portion of the main fluid circuit that is located above the fill level. This reduces the volume of liquid that remains above the fill level when the engine is not operating.

19 Claims, 2 Drawing Sheets

FLUID SYSTEM AND METHOD OF CONTROLLING FLUID FLOW FOR AN INTERCOOLER

FIELD

The present disclosure relates to an intercooler fluid system and a method of controlling fluid flow in an intercooler fluid system.

BACKGROUND

Certain vehicles utilize an intercooler to decrease the temperature of the air flow to an engine. A liquid-to-air intercooler utilizes a fluid flow circuit through which a supply of liquid (e.g. water or other coolant) is routed to and from the intercooler. If the intercooler and/or a portion of its fluid system is located above an engine intake port, then fluid that may leak from the intercooler and/or upper portion of the fluid system can enter one or more engine cylinders, which can be detrimental to engine operation.

SUMMARY

A fluid system for an intercooler has a fill level defining a maximum volume of liquid in the fluid system, a main fluid circuit and a secondary fluid volume. The main fluid circuit includes the intercooler, and one or more passages through which fluid is circulated with operation of the engine, and at least a portion of the main fluid circuit is located above the fill level. The secondary fluid volume has at least a portion located below the fill level that communicates with the main fluid circuit to receive liquid from the main fluid circuit at least when the engine is not operating to drain at least some of the liquid from the portion of the main fluid circuit that is located above the fill level. This reduces the volume of liquid that remains above the fill level when the engine is not operating.

In at least some implementations, a fluid system for an intercooler includes a main fluid circuit, a secondary fluid volume and a valve. The main fluid circuit includes the intercooler and one or more passages through which fluid is routed to and from the intercooler. At least a portion of the main fluid circuit including at least a portion of the intercooler is located above a fill level of the fluid system. The secondary fluid volume communicates with the main fluid circuit to receive liquid from the main fluid circuit when the engine is not operating so that at least some of the liquid from the portion of the main fluid circuit that is located above the fill level flows into the secondary fluid volume. This reduces the volume of liquid that remains above the fill level when the engine is not operating. The valve is disposed between the main fluid circuit and the secondary fluid volume to selectively permit fluid flow from the main fluid circuit to the secondary fluid volume through the valve. The combined volume of the main fluid circuit and the secondary fluid volume is greater than the volume of liquid in the fluid system providing a volume of air within the fluid system.

A method of controlling fluid flow for an intercooler fluid system having a portion located above an engine is also described. The method includes providing a main fluid circuit through which liquid is cycled through the intercooler, providing a secondary fluid volume in which a volume of air is maintained during engine operation, and transferring the air from the secondary fluid volume to the main fluid circuit when the engine is not operating to reduce the volume of liquid in the main fluid circuit that is located above the engine. This reduces the amount of liquid that may flow into the engine if there is a leak in the fluid system (for example from a crack or rupture) above some entrance path into the engine.

Further areas of applicability of the present disclosure will become apparent from the detailed description and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1:
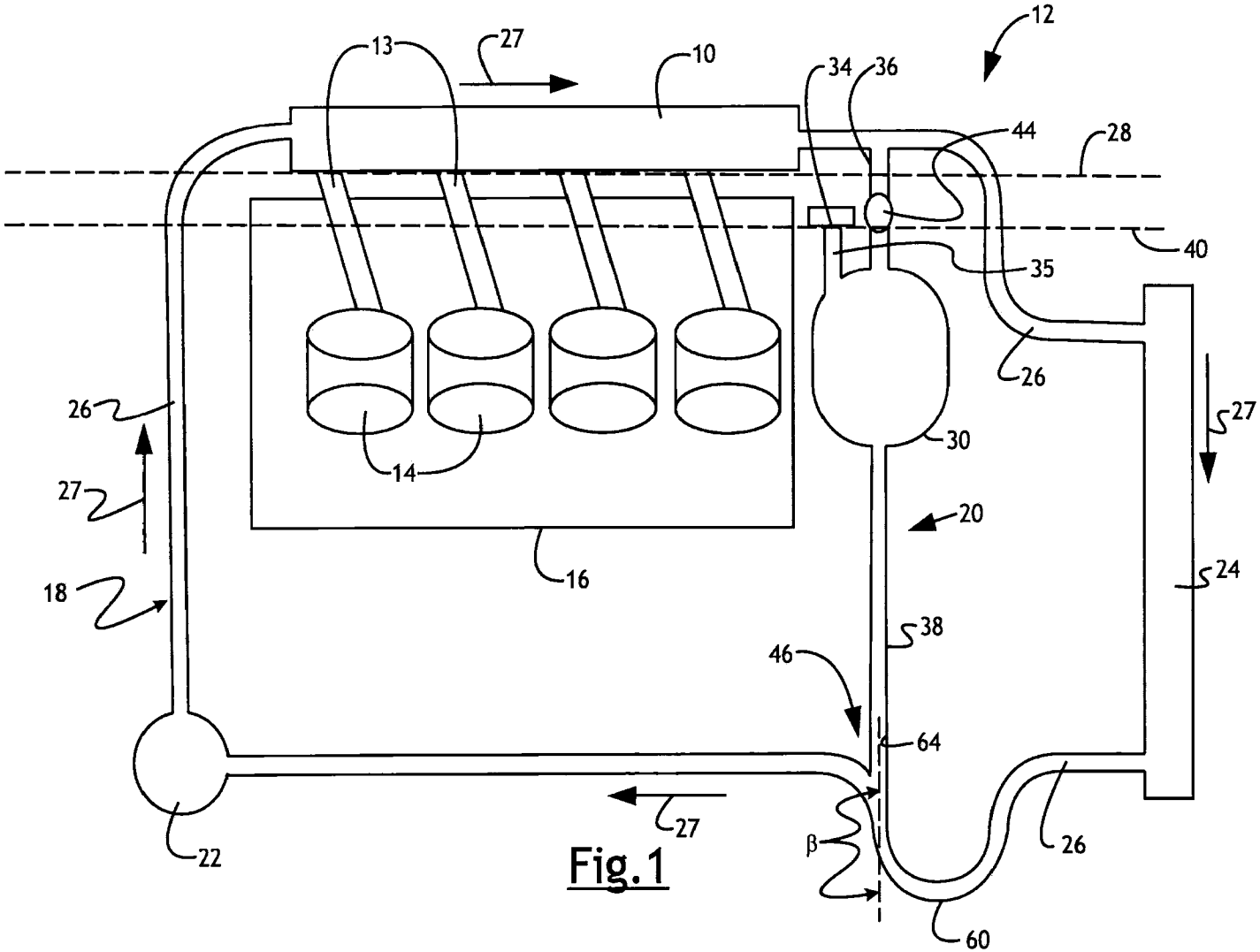
FIG. 1 is a diagrammatic view of a fluid system for an intercooler.

Referring in more detail to the drawings, FIG. 1 diagrammatically illustrates an intercooler 10 and its fluid system 12, as well as intake ports/passages 13 of a manifold and cylinders 14 of an engine 16 with which the intercooler 10 is used. The intercooler 10 may be a liquid-to-air type intercooler that uses a liquid coolant that is routed to and from the intercooler through the fluid system 12. The function and operation of intercoolers are well known and will not be set forth in detail here. As shown in FIG. 1, all or a portion of the intercooler 10 and/or its fluid system 12 are located above the engine 16 and so fluid leakage from the intercooler 10 or other portion of the fluid system 12 located above the engine 16 might find its way into one or more engine cylinders 14.

The fluid system 12 may include a main fluid circuit 18 and a secondary fluid volume 20. The main fluid circuit 18 may include a pump 22 to move fluid through the fluid system 12, the intercooler 10, a heat exchanger 24 (such as a radiator) to remove heat from the fluid downstream of the intercooler 10 and a plurality of hoses and/or passages 26 interconnecting the components of the main fluid circuit 18. As viewed in FIG. 1, fluid is routed through the main fluid circuit 18 clockwise, as shown by arrows 27, from the pump 22, to the intercooler 10, then to the heat exchanger 24 and back to the pump 22. At least a portion of the main fluid circuit 18 is located above the engine 16, and above a threshold level 28 (indicated by a dashed line in FIG. 1) which represents a level above which fluid, if leaked from the fluid system 12, could find its way into a cylinder 14 of the engine 16 through one or more ports, plenums, and the like. Fluid below the threshold level 28 generally would not flow into the engine even if leaked from the main fluid circuit 18. In the implementation shown, at least part of the intercooler 10 and part of the main fluid circuit in addition to the intercooler is located above the engine 16 and above the threshold level 28.

The secondary fluid volume 20 may include a reservoir 30 and one or more tubes and/or passages connected to the main fluid circuit 18. In the implementation shown, the reservoir 30 is coupled to the main fluid circuit 18 via a first passage 36 and a second passage 38, and collectively, the reservoir 30, second passage 38 and at least a portion of the first passage 36 may define the secondary fluid volume 20. The first passage 36 may be located above the reservoir 30 and communicates with an upper portion of the main fluid circuit 18 that is above the threshold level 28. The second passage 38 may extend below the reservoir 30 and communicates with a portion of the main fluid circuit 18 located below the reservoir 30. Of course, a distinct reservoir is not needed. The secondary fluid volume 20 could be comprised of any components capable of receiving fluid therein (for example, without limitation, tubes, coils, passages of another heat exchanger or other component, a long fill tube through which fluid is added to the system 12, etc).

The reservoir 30 may also include a fill opening 34, which may be formed in a fill tube 35, through which liquid may be added to the fluid system 12. The fill opening 34 defines a maximum fill level for the fluid system 12 when the engine is not operating, and hence, a maximum volume of liquid in the fluid system 12. This may be called the static fill level of the fluid system 12 and is indicated by dashed line 40 in FIG. 1. The fill level 40 may be below at least a portion of the intercooler, and, in the implementation shown in FIG. 1, is below the entire intercooler 10 and at least a portion of the engine (for example, below the level of intake ports 13). And at least a portion of the secondary fluid volume 20 is located below or lower than the intercooler 10, and below the fill level 40. As shown in FIG. 1, substantially all of the secondary fluid volume 20 may be located below the level of the intercooler and the threshold level 28.

With the fill level 40 being lower than at least part of the main fluid circuit 18, a volume of air is present within the fluid system 12. That is, the combined volume of the main fluid circuit 18 and secondary fluid volume 20 is greater than the volume of liquid in the fluid system 12. In at least one implementation, the volume of air is less than the volume of the secondary fluid volume 20. In this way, the secondary fluid volume 20 can accommodate all of the air in the fluid system 12 so that when the engine 16 is operating, the main fluid circuit 18 can be completely filled with liquid. To reduce or prevent fluid from leaking into the engine cylinders 14 when the engine 16 is not operating, the air may be released or transferred from the secondary fluid volume 20 to the main fluid circuit 18 so that at least part, and up to all, of the portion of the main fluid circuit 18 located above the threshold level 28 may be substantially or completely filled with air. Thereafter, when the engine is operating, the air may be transferred back to the secondary fluid volume 20 from the main fluid circuit 18, so that the main fluid circuit is fully or at least substantially filled with liquid during engine operation.

To control fluid flow between the main fluid circuit 18 and secondary fluid volume 20, a valve 44 may be provided in the first passage 36 above the reservoir 30. When the valve 44 is closed, fluid flow between the main fluid circuit 18 and secondary fluid volume 20 through the first passage 36 is prevented. When the valve 44 is open, at least some of the liquid in the main fluid circuit 18 that is above the level of the valve 44 may flow through the valve 44 and into the reservoir 30 and second passage 38. Further, air in the secondary fluid volume 20 flows through the open valve 44 and into the main fluid circuit 18 where the air occupies the uppermost portion of the main fluid circuit 18, as noted above.

The valve 44 may be electrically operated, such as a solenoid valve, and may be normally open so that when electricity is not supplied to the valve 44, the valve 44 opens to permit flow through the first passage 36. When the engine 16 is operating, electricity is provided to the valve 44 to close the valve 44 and prevent fluid flow through the valve 44. Of course, the valve 44 could be normally closed and operated upon engine shutdown to move to its open position for a period of time sufficient to drain all or at least some of the liquid in the main fluid circuit 18 that is located above the threshold level 28, and then the valve 44 may be closed or allowed to return to its closed position after that time. Also, the valve need not be electrically operated. For example, without limitation, a vacuum operated valve driven by an engine vacuum signal between open and closed positions, or any other suitable valve could be used.

When the volume of the portion of the secondary fluid volume 20 located below the fill level 40 is greater than the volume of the main fluid circuit 18 that is located above the fill level 40, the liquid in the main fluid circuit 18 that is located above the fill level 40 may completely drain into the secondary fluid volume 20 through the first passage 36 when the valve 44 is opened. In at least some implementations, the fill level 40 is at or below the threshold level 28 where leaked fluid may find its way into an engine cylinder, as is shown in FIG. 1. In that case, when the engine 16 is not operating the fluid system 12 does not contain fluid above the threshold level 28. Instead, air is present in that portion of the fluid system 12. Hence, even if there is a leak or crack in the fluid system 12 above the threshold level 28, fluid will not drain or leak into one or more engine cylinders. Even if some residual liquid remains in the fluid system 12 above the threshold level 28, it will not be a significant volume of liquid and any leakage from the fluid system 12 to the engine 16 will be limited.

In at least some implementations, the fill level 40 may be set at a level higher than the threshold level 28 which would leave some liquid in the main fluid circuit 18 that could potentially leak into the engine 16. In at least some implementations, the volume of liquid that remains in the main fluid circuit 18 above the threshold level 28 when the engine 16 is not operating is less than the volume of a cylinder 14 to a top dead center (TDC) position of a piston in the cylinder 14. If a cylinder 14 is filled with fluid above the TDC position, the engine 16 may be hydraulically locked and unable to operate. Accordingly, so long as less liquid leaks into an engine cylinder 14, the engine 16 should still be able to operate, although repair likely will need to be performed to correct the leak. Accordingly, if desired, the fill level 40 can be set so that no or substantially no liquid is available to leak or flow into an engine cylinder 14 when the engine 16 is not operating. Or, the fill level 40 can be set at a higher level where some liquid, if leaked, may flow into an engine cylinder 14 but the amount of liquid that remains above the threshold level 28 is less than the amount of liquid above that level 28 when the engine is operating. Of course, the threshold level 28 may also coincide with the static fill level 40.

When the engine 16 is operating, the valve 44 is closed and the fluid pump 22 is operated to move fluid through the main fluid circuit 18. As fluid is pumped through the drained portion of the main fluid circuit 18, the air therein is displaced by the fluid. The displaced air flows through the main fluid circuit 18 to a junction 46 of the second passage 38 where at least some of the air enters the second passage 38 and flows to the top of the reservoir 30. The air displaces a like volume of fluid from the secondary fluid volume 20 into the main fluid circuit 18 through the junction 46. After the fluid is cycled through the main fluid circuit 18 one or more times, the air may be removed from the main fluid circuit 18 and transferred to the secondary fluid volume 20. Thus, the main fluid circuit 18 is filled with fluid and does not contain air (or any significant volume of air) to provide the maximum heat transfer capability and efficiency in the main fluid circuit 18. The air is now all (or substantially all) contained within the secondary fluid volume 20. In this way, the air volume is transferred from the main fluid circuit 18 to the secondary fluid volume 20 when the engine 16 is turned off or not operating, and transferred back from the main fluid circuit 18 to the secondary fluid volume 20 when the engine 16 is operating. This disclosure generally encompasses any method or way of transferring the air in this manner, including the example fluid system 12 shown in FIG. 1 and its operating scheme.

As shown in FIG. 1, a portion of the passage 26 in the main fluid circuit 18 that is upstream of the junction 46 may be contoured and have a dip 60 or portion that extends lower than the level of the inlet 64 of the second passage 38. And this dip 62 may lead to a near vertical portion of the passage 60 at the junction 46, such that an angle β is about 180 degrees. This may facilitate the passage of air into the second passage 38 from the main fluid circuit 18 to reduce the amount of time and number of fluid cycles needed to remove air from the main fluid circuit 18. Any angle or type of junction may be used with or without a dip or low section in the adjacent portion of the main fluid circuit, as desired.

Figure 3:
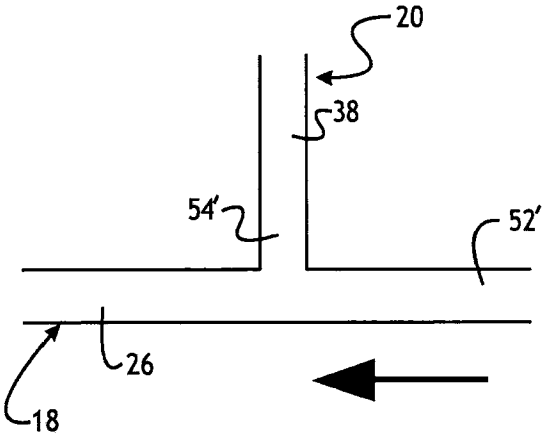
FIG. 3 is an enlarged fragmentary view of a junction that may be used in the fluid system.
Figure 2:
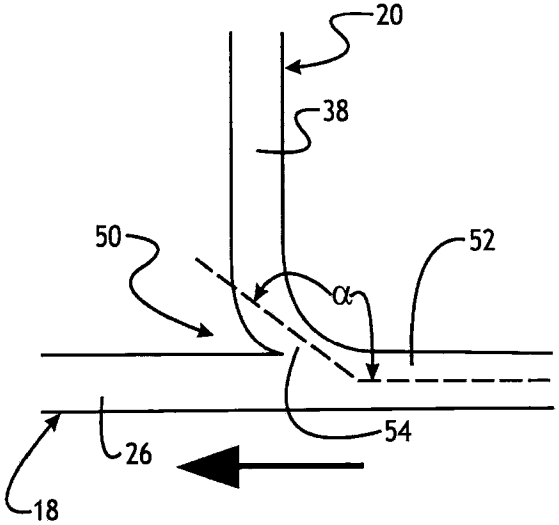
FIG. 2 is an enlarged fragmentary view of one style of a junction that may be used in the fluid system.

FIGS. 2 and 3 illustrate two junction configurations that could be used to connect the second passage 38 with the main fluid circuit 18. Of course, other junctions or connection arrangements and styles may be used. As shown in FIG. 2, a junction 50 of the second passage 38 is angled to face the direction of flow in the main fluid circuit 18. Stated differently, an angle α defined between an adjacent section 52 of the main fluid circuit 18 upstream of the junction 50 and an inlet 54 of the second passage 38 is greater than 90 degrees. This may facilitate the flow of air into the second passage 38 since the air will tend to rise within and to the top of the passages. FIG. 3 illustrates a simple "t" connection where the second passage inlet 54□ is at a right angle to the adjoining, upstream tube 52□ of the main fluid circuit 18. An angle of less than 90 degrees may be used, although it may require more cycles of the fluid through the main fluid circuit 18 to remove air from the liquid. In general, the idea is to use the buoyancy of the air to cause the air to move from the main fluid circuit 18 into the secondary fluid volume 20 through the second passage inlet.

In systems were liquid is not removed from above the threshold level when an engine is not operating, any liquid that leaks from the intercooler or portions of the fluid system above the threshold level could flow into the engine. During engine operation, such leakage generally is at a slow rate that is passed by the operating engine without more serious engine issues, although any liquid leak to the engine from the fluid system is not desired. However, when the engine is shutdown for a period of time sufficient to allow a greater volume of liquid to leak into the engine, more serious problems with the engine can result, such as hydraulic lock. Such problems are avoided or reduced in severity by draining into a secondary volume at least a portion of the volume of fluid that would otherwise be available to leak into the engine, as described above with reference to FIGS. 1-3.

What is claimed is:

1. A fluid system for an intercooler and having a fill level defining a maximum volume of liquid in the fluid system, the fluid system comprising:

a main fluid circuit through which liquid is circulated with operation of the engine, the main fluid circuit including the intercooler, and one or more passages through which fluid is routed, and at least a portion of the main fluid circuit is located above the fill level; and a secondary fluid volume having at least a portion located below the fill level that communicates with the main fluid circuit to receive liquid from the main fluid circuit at least when the engine is not operating to drain at least some of the liquid from the portion of the main fluid circuit that is located above the fill level thereby reducing the volume of liquid that remains above the fill level when the engine is not operating, wherein the combined volume of the main fluid circuit and the secondary fluid volume is greater than the volume of liquid in the fluid system providing a volume of air in the fluid system, and where the volume of air is contained within the secondary fluid volume during engine operation, and is permitted to flow into the main fluid circuit when the engine is not operating.

2. The fluid system of claim 1 which also includes a valve that selectively permits fluid flow between the main fluid circuit and the secondary fluid volume through the valve.

3. The fluid system of claim 2 wherein the valve is closed when the engine is operating to prevent fluid flow from the main fluid circuit to the secondary fluid volume through the valve, and the valve is open at least part of the time that the engine is not operating to permit fluid flow through the valve.

4. The fluid system of claim 1 wherein at least a portion of the intercooler is located above the fill level.

5. The fluid system of claim 1 wherein the volume of the portion of the secondary fluid volume that is located below the fill level is equal to or greater than the volume of the portion of the main fluid circuit that is located above the fill level.

6. The fluid system of claim 1 wherein the secondary fluid volume includes a reservoir to which additional liquid can be added to the fluid system, and the reservoir is located at a level below the intercooler.

7. The fluid system of claim 1 wherein the fluid system includes a threshold level above which leaked liquid can flow into an engine with which the intercooler is used, and the fill level is at or below the threshold level.

8. The fluid system of claim 1 wherein the secondary fluid volume includes a passage connected to the main fluid circuit at a junction including an inlet to the passage, and said inlet is arranged at an angle relative to the adjacent section of the main fluid circuit so that air in the main fluid circuit flows into the secondary fluid volume due to the buoyancy of the air.

9. The fluid system of claim 8 wherein the main fluid circuit includes a passage with a portion located upstream of the inlet and at a level below the level of the inlet.

10. A fluid system for an intercooler, comprising:

a main fluid circuit through which liquid is circulated in operation of the engine, the main fluid circuit including the intercooler and one or more passages through which fluid is routed to and from the intercooler, and at least a portion of the main fluid circuit including at least a portion of the intercooler is located above a fill level of the fluid system;

a secondary fluid volume that contains a volume of air separate from the main fluid circuit when the engine is operating and communicates with the main fluid circuit to receive liquid from the main fluid circuit when the engine is not operating so that at least some of the liquid from the portion of the main fluid circuit that is located above the fill level flows into the secondary fluid volume thereby reducing the volume of liquid that remains above the fill level when the engine is not operating; and a valve disposed between the main fluid circuit and the secondary fluid volume to selectively permit fluid flow from the main fluid circuit to the secondary fluid volume through the valve, the combined volume of the main fluid circuit and the secondary fluid volume is greater than the volume of liquid in the fluid system providing a volume of air within the fluid system.

11. The fluid system of claim 10 wherein the valve is closed when the engine is operating to prevent fluid flow through the valve, and the valve is opened when the engine is not operating to permit air in the secondary fluid volume to flow into the main fluid circuit and liquid in the main fluid circuit to flow into the secondary fluid volume.

12. The fluid system of claim 11 wherein the volume of the portion of the secondary fluid volume that is located below the fill level is equal to or greater than the volume of the portion of the main fluid circuit that is located above the fill level.

13. The fluid system of claim 10 wherein the fill level is at or below a threshold level above which leaked liquid can flow into an engine so that liquid in the main fluid circuit above the threshold level may drain to the secondary fluid volume when the valve is open.

14. The fluid system of claim 1 wherein the intercooler is located above the fill level.

15. The fluid system of claim 10 wherein the secondary fluid volume includes a passage connected to the main fluid circuit at a junction defining an inlet to the passage, and said inlet is arranged at an angle relative to the adjacent section of the main fluid circuit so that air in the main fluid circuit flows into the secondary fluid volume due to the buoyancy of the air.

16. The fluid system of claim 15 wherein the main fluid circuit includes a passage with a portion located upstream of the inlet and at a level below the level of the inlet.

17. A method of controlling fluid flow for an intercooler fluid system having a portion located above an engine, comprising:

providing a main fluid circuit through which liquid is cycled through the intercooler;

providing a secondary fluid volume in which a volume of air is maintained during engine operation; and transferring the air from the secondary fluid volume to the main fluid circuit when the engine is not operating to reduce the volume of liquid in the main fluid circuit that is located above the engine.

18. The method of claim 17 wherein the air is transferred from the secondary fluid volume to the main fluid circuit by opening a valve and permitting liquid above the valve in the main fluid circuit to drain into the secondary fluid volume while the air flows from the secondary fluid volume to the main fluid circuit.

19. The method of claim 18 which also includes closing the valve when the engine is operating to prevent fluid flow through the valve.

* * * * *